US010739099B2

(12) United States Patent
Bowman

(10) Patent No.: US 10,739,099 B2
(45) Date of Patent: Aug. 11, 2020

(54) ADJUSTABLE FIREARM SUPPORT

(71) Applicant: Lorne Bowman, Pembroke, VA (US)

(72) Inventor: Lorne Bowman, Pembroke, VA (US)

( * ) Notice: Subject to any disclaimer, the term of this patent is extended or adjusted under 35 U.S.C. 154(b) by 52 days.

(21) Appl. No.: 14/531,091

(22) Filed: Nov. 3, 2014

(65) Prior Publication Data

US 2015/0121741 A1 May 7, 2015

Related U.S. Application Data

(60) Provisional application No. 61/898,770, filed on Nov. 1, 2013.

(51) Int. Cl.
*F41A 23/10* (2006.01)
*F41C 23/14* (2006.01)
*F41C 23/16* (2006.01)

(52) U.S. Cl.
CPC ..... *F41A 23/10* (2013.01); *F41C 23/14* (2013.01); *F41C 23/16* (2013.01)

(58) Field of Classification Search
CPC .... F41A 23/02–14; F41C 23/04; F41C 23/14; F41C 23/16
USPC ..... 42/73, 94; 89/37.04, 40.01, 40.06
See application file for complete search history.

(56) References Cited

U.S. PATENT DOCUMENTS 2,386,802 A * 10/1945 Johnson, Jr. ..... F41A 23/00 42/94
4,265,045 A * 5/1981 Garbini ..... F41A 23/00 42/94
4,393,614 A * 7/1983 Pickett ..... F41A 23/06 42/94
5,345,706 A * 9/1994 Brown ..... F41A 23/06 42/94
5,347,740 A * 9/1994 Rather ..... F41C 27/00 396/426
5,852,892 A 12/1998 Bilgeri et al.
5,937,560 A * 8/1999 Beltz ..... F41A 23/06 42/94
6,032,911 A * 3/2000 Osborne ..... F41A 23/18 248/229.15
6,598,329 B1 * 7/2003 Alexander ..... F41C 23/04 42/114
6,901,691 B1 * 6/2005 Little ..... F41A 23/02 42/118
7,100,318 B1 * 9/2006 Beltz ..... F41A 23/06 248/274.1
7,421,815 B1 9/2008 Moody et al.
(Continued)

*Primary Examiner* — Stephen Johnson
*Assistant Examiner* — Benjamin S Gomberg
(74) *Attorney, Agent, or Firm* — Bennet K. Langlotz; Langlotz Patent & Trademark Works, LLC

(57) ABSTRACT

Adjustable firearm supports including a forward grip and associated methods of manufacturing and using the supports are disclosed. In an embodiment, an adjustable firearm support is provided, which comprises: an adjustment assembly configured to attach to a firearm; and a support body extending from the adjustment assembly, the support body including a forward grip and at least one support leg; wherein the adjustment assembly is operably configured to provide for rotation and positioning of the support body at any point relative to the firearm. Adjustable firearm supports of the invention are particularly useful for competitive shooting to provide for unlimited positioning of the firearm over a particular range relative to a target.

18 Claims, 9 Drawing Sheets

(56) References Cited

U.S. PATENT DOCUMENTS

| | | | | |
|---|---|---|---|---|
| 7,426,800 | B2 * | 9/2008 | Pierce | F41A 23/10<br>248/166 |
| 7,571,563 | B2 * | 8/2009 | Peterson | F41A 23/08<br>248/165 |
| 7,631,455 | B2 * | 12/2009 | Keng | F16M 11/10<br>248/163.1 |
| 7,676,979 | B1 * | 3/2010 | Mertz | F41A 23/08<br>42/71.01 |
| 2009/0313873 | A1 * | 12/2009 | Roth | F41C 23/16<br>42/72 |
| 2012/0266513 | A1 * | 10/2012 | Gnesda | F41A 23/08<br>42/72 |

* cited by examiner

ADJUSTABLE FIREARM SUPPORT

CROSS-REFERENCE TO RELATED APPLICATIONS

The present application relies on the disclosure of and claims priority to and the benefit of the filing date of U.S. Provisional Application No. 61/898,770, filed Nov. 1, 2013, the disclosure of which is hereby incorporated by reference herein in its entirety.

BACKGROUND OF THE INVENTION

1. Field of the Invention

This disclosure relates generally to firearm bipods. More specifically, this disclosure relates to a multifunctional adjustable support and forward grip for a firearm.

2. Description of Related Art

A steady and comfortable shooting platform is essential to accuracy in shooting sports. Various types of gun supports have been used since the earliest personal firearms to provide a stable shooting platform. For example, U.S. Pat. Nos. 5,852,892; 7,421,815; 7,631,455; and 7,676,979, which are incorporated by reference herein in their entireties are representative. Shooting sticks have been used for centuries as a simply way to provide a forward support for long firearms. Shooting sticks may include one to three sticks of a desired length that are used to support and steady a forward portion of a firearm. Various bipods attached to firearms have been used for many years to provide an attached and portable support. However, attached bipods are mostly used with heavier rifles, machine guns, and weapons where accuracy is critical, such as competitive shooting arms, some hunting rifles, and sniper rifles. Having a bipod or other gun support can be crucial during long hunts, particular where the hunter is in a static location such as a hunting blind. A bipod allows for continual scanning of a likely area where game is expected to appear with minimal fatigue to the hunter. Similarly, soldiers tasked to guard a perimeter or defensive area requires hours of constant scanning, watching, and weapon readiness, which can be aided greatly by a bipod. Most mounted bipods, however, add significant weight and bulk making them a hindrance when transporting or carrying a weapon having a mounted bipod. Additionally, bipods can be used in competitive shooting to allow the competitor to execute shots accurately and efficiently. An adjustable bipod with several degrees of freedom would be highly desirable in competitive shooting to provide the competitor with a vast range of movement when aligning a firearm with a particular target.

SUMMARY OF THE INVENTION

Adjustable firearm supports including a forward grip and associated methods of manufacturing and using the supports are disclosed. In some embodiments, adjustable firearm supports may include an adjustment assembly configured to attach to a firearm, and a support body extending from the adjustment assembly. The support body may include a forward grip and at least one support leg, but preferably two or more support legs. In embodiments, a tripod type support may also be used. The adjustment assembly is configured to attach to the lower receiver of the firearm. The adjustment assembly may be configured to attach adjacent to the chamber of the firearm. At least one support leg may be a bipod, and the bipod may be configured to be positioned at any point between the chamber and the distal end of the barrel of the firearm. Indeed, it is not critical where the support leg is positioned relative to the chamber and distal end of the barrel, however, it is best positioned where the weight of the firearm can be balanced on the support.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter, but merely to provide exemplary embodiments.

Additional features and advantages are be set forth in the detailed description which follows, and in part will be apparent from the description, or may be learned by the implementation of the principles of the embodiments disclosed and described below. The features and advantages may be realized and obtained by means of the instruments and combinations particularly pointed out in the appended claims.

BRIEF DESCRIPTION OF THE DRAWINGS

In order to describe the manner in which the above-recited and other advantages and features of the disclosed embodiments can be obtained, a more particular description will be provided by reference to specific embodiments which are illustrated in the appended drawings. The drawings depict only exemplary embodiments and are not, therefore, to be considered to be limiting of its scope. The embodiments will be described and explained with additional specificity and detail through the use of the accompanying drawings in which.

Figure 1:
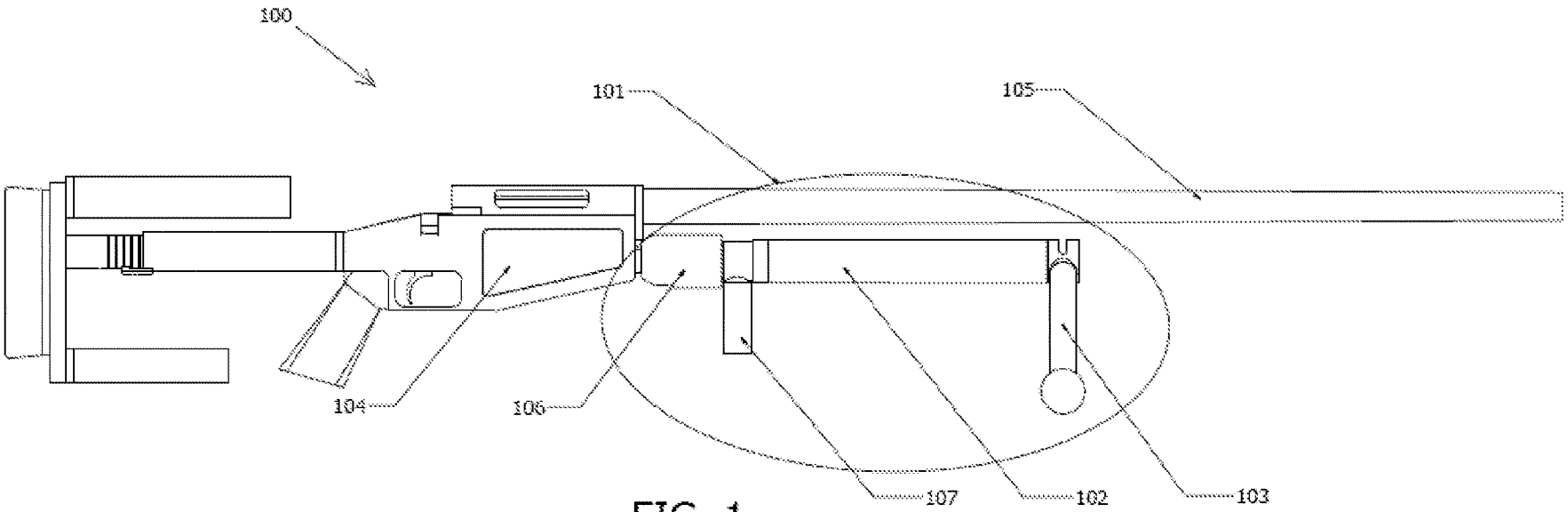
FIG. 1 is a schematic drawing of a firearm and adjustable firearm support.

Together with the following description, the Figures demonstrate and explain the principles of adjustable firearm supports including forward grip and methods for using and employing them. In the Figures, the size, number and configuration of components may be exaggerated for clarity. In some Figures, components have been omitted to allow for illustration of internal components. The same reference numerals in different Figures represent the same component.

DETAILED DESCRIPTION OF VARIOUS EMBODIMENTS OF THE INVENTION

The following description supplies specific details in order to provide a thorough understanding. Nevertheless, the skilled artisan would understand that embodiments of adjustable firearm supports including forward grips and associated methods of making and using them can be implemented and used without employing these specific details. Indeed, exemplary embodiments and associated methods can be placed into practice by modifying the illustrated units and associated methods and can be used in conjunction with any other devices and techniques conventionally used in the industry. For example, while embodiments described in detail below focus on adjustable firearms supports for bolt-action rifles, the disclosed principles may be applied to adjustable supports including a forward grip for semi-automatic rifles, various pistols, crossbows, or other types of projectile weapons.

One exemplary embodiment of an adjustable firearm support including forward grip is illustrated in FIGS. 1, 2, 3A, 3B, 4A, and 4B. As shown in FIG. 1, an adjustable firearm support system 100 is provided. As shown, the adjustable firearm support 101 may provide a forward grip 102 and bipod 103 extending from the lower receiver 104 of a firearm 105. The forward grip 102 and bipod 103 may be generally described as the support body 101 throughout this document. Support body 101 may extend from an adjustment assembly 106 coupled between the support body 101 and the lower receiver 104 of the firearm 105. In some embodiments, adjustment assembly 106 may be connected to the upper receiver or other similar structure adjacent to the chamber of the firearm. An adjustment grip may also be provided on the support body 101 that may also function as a close grip.

The support body 101 may include an extended forward grip 102, an adjustment handle 107, and bipod 103. The bipod may extend from the extended forward grip and may include a pair of legs. In some embodiments, the legs include ends that may provide a cushioned interface for contact with a support surface. The ends may be formed of rubber, plastic, or any other suitable material for providing a stable shooting platform. As shown in the Figures, the legs of support body 101 may be fixed with respect to the support body. For example, a pair of legs may extend from the extended forward grip generally perpendicular to the forward grip and at between about a 30 to 120 degree angle from each other, such as at about a 45, 60, or 90 degree angle. However, in some embodiments, the legs may be adjustable in length, or may be foldable forward or against the forward grip 102 portion of the support body 101 or away from the forward grip 102. Additionally, the legs may provide some pivot with respect to the forward grip as well, to allow for adjustment when operating a firearm to which the adjustable support is attached.

The legs may be attached to the support body 101 in a position such that when the support body 101 is generally parallel to the barrel of the firearm 105, the legs are positioned generally perpendicular to the barrel and adjacent to the forward half of the barrel. In such a configuration, the legs provide stable support as a bipod for the firearm as a shooting platform and the forward grip functions to provide a shooter a forward grip. In some embodiments, the legs may be located at a distal end of the support body 101 extended away from the adjustment assembly 106 and the forward receiver. Similarly, adjustment grip 107 may be located proximate to the adjustment assembly 106 and may be a functional component of the adjustment assembly 106, as will be described in detail below.

Figure 2:
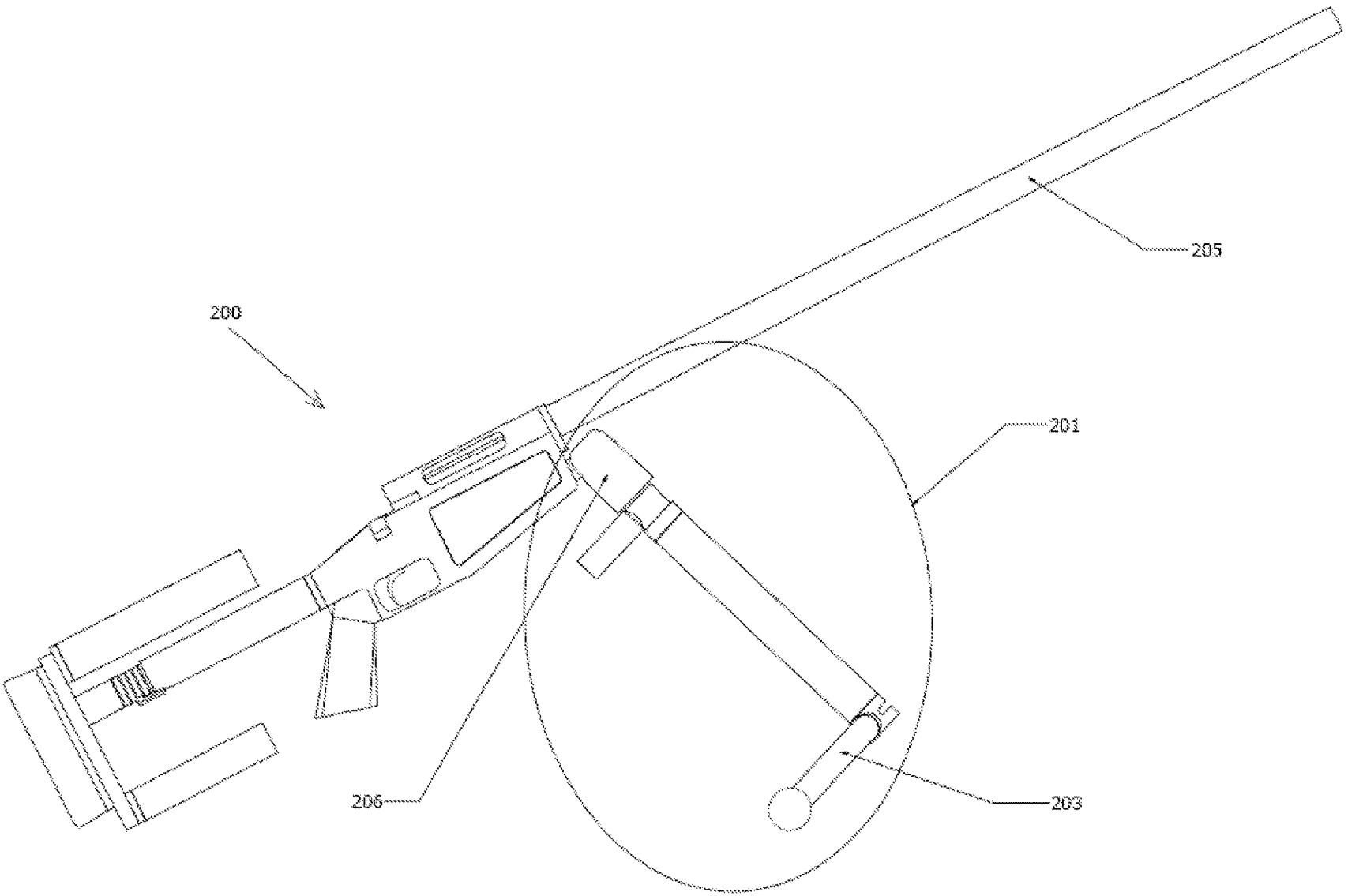
FIG. 2 is a schematic drawing of the firearm and exemplary support of FIG. 1 adjusted to a different position than that depicted in FIG. 1.

As shown in FIG. 2, the support body 201 may be adjusted to provide an elevated shooting platform to account for different ground or support conditions, or to provide an angled forward grip or adjustment grip for the comfort of the shooter. As illustrated, the adjustment assembly 206 (described in further detail below) of the firearm support system 200 may be used to adjust the angle of the support body 201 with respect to the barrel of the firearm 205, between about 0 and 90 degrees, and at any angle in between, such as 10, 15, 20, 30, 45, 60, 70, or 80 degrees. In preferred embodiments, the adjustment assembly 206 is a ball and socket type joint which provides for positioning of the firearm 205 in a vast number of positions horizontally and/or vertically. In embodiments, the bipod 203 is infinitely adjustable within the range of travel of the ball socket.

The support body may be sized according to the length of the firearm to which it is attached. For example, for a 30" barrel, the support body may extend between about 12" and 26" from the adjustment assembly, thereby providing an adjustable forward grip and a bipod extended along the barrel. In other embodiments, the body may be sized as desired and may even extend past the end of the barrel, depending on the desired configuration.

Figure 3A:
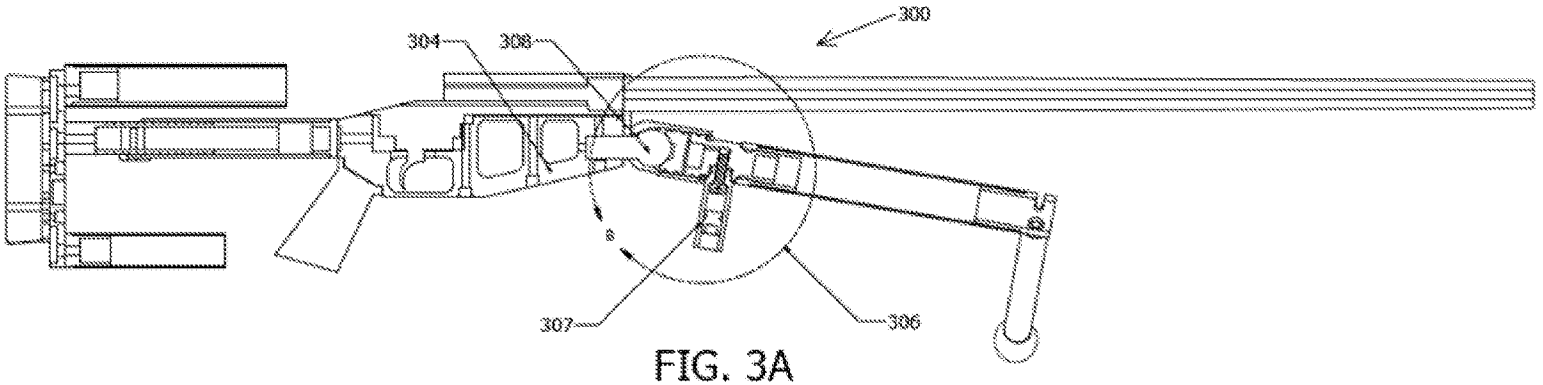
FIGS. 3A and 3B are schematic drawings illustrating a cross-sectional view of the exemplary support of FIG. 1.
Figure 3B:
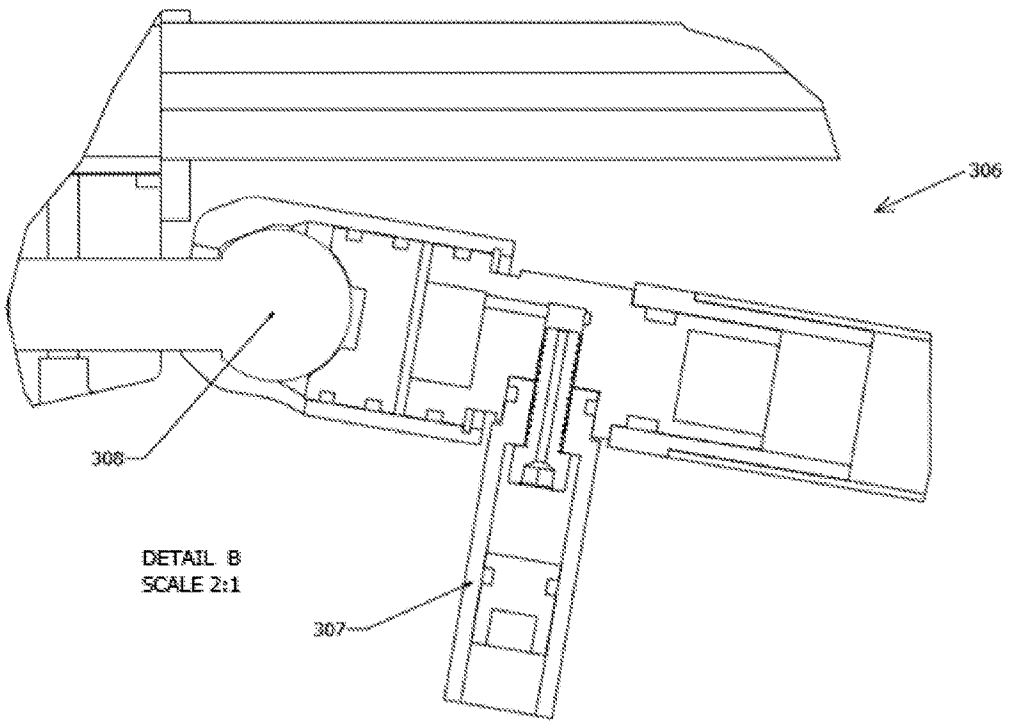

As shown in FIGS. 3A-B, an adjustable firearm support system 300 is provided. The adjustment assembly 306 may include an adjustment handle 307 (adjustment knob not shown), and a ball and socket joint 308. The ball of the ball and socket joint 308 may be attached to the lower receiver 304 of the firearm in a fixed relationship. The ball may be attached using a bolt, welding, or rivet, or may be integrally formed in the lower receiver, or may otherwise extend from adjacent to the chamber of the firearm by any known manufacturing technique. The socket portion of the ball and socket joint may be formed in or attached to the support body. The socket portion may include a pressure membrane within the socket. The pressure membrane may separate the socket from a channel in fluid connection with the adjustment handle. With the ball and socket adjustment assembly, the support body may be rotated about the axis of the forward grip as well as radially with respect to the barrel as described above to provide various configurations, such as are shown in FIGS. 4A and 4B.

The adjustment handle may be turned to loosen or tighten a ball and socket joint to allow adjustment of the support body. Turning the adjustment handle clockwise advances a screw within a shaft in the handle, which then compresses a fluid, such as air, oil, or water, in a passageway between the handle and a pressure membrane in the ball and socket joint. The compressed fluid presses the pressure membrane against the ball of the ball and socket joint, thereby increasing friction between the ball and the socket, holding the ball and socket and the support arm in place. Similarly, turning the adjustment handle counter-clockwise reduces the pressure in the passageway and reduces the friction between the pressure membrane and the ball.

Figure 4A:
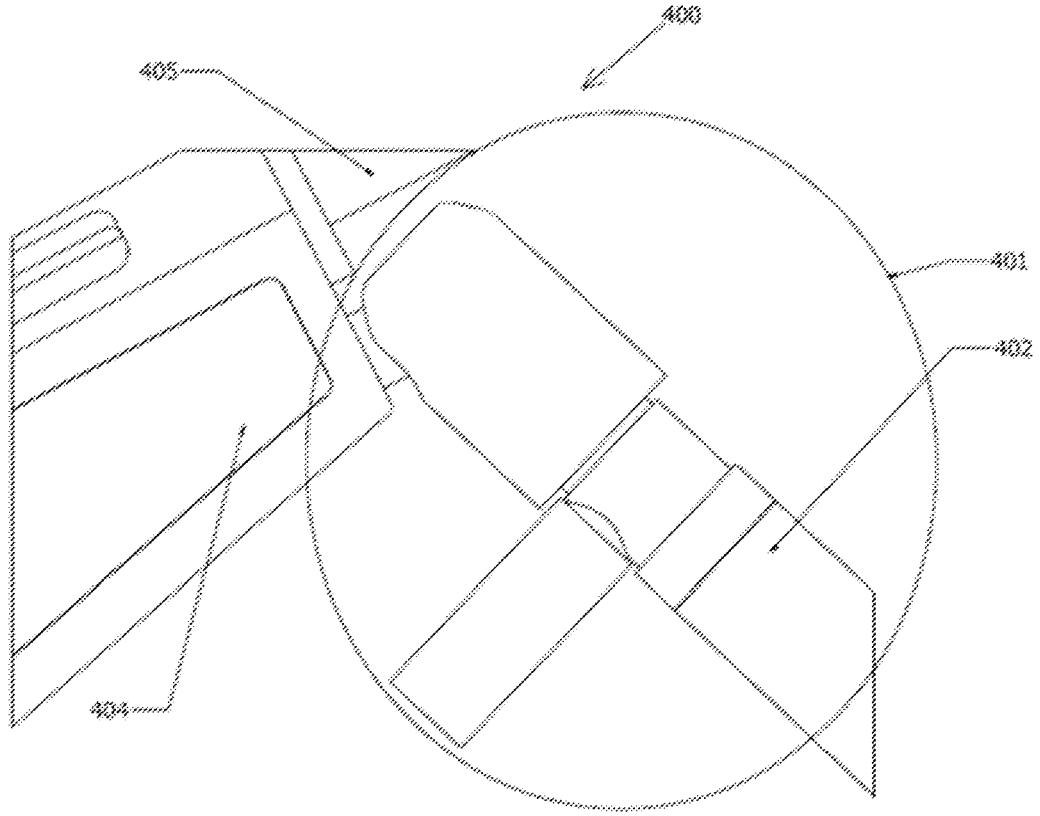
FIGS. 4A and 4B are schematic drawings illustrating a close up view of the adjustment mechanism and alternate positionings of the exemplary support of FIG. 1.
Figure 4B:
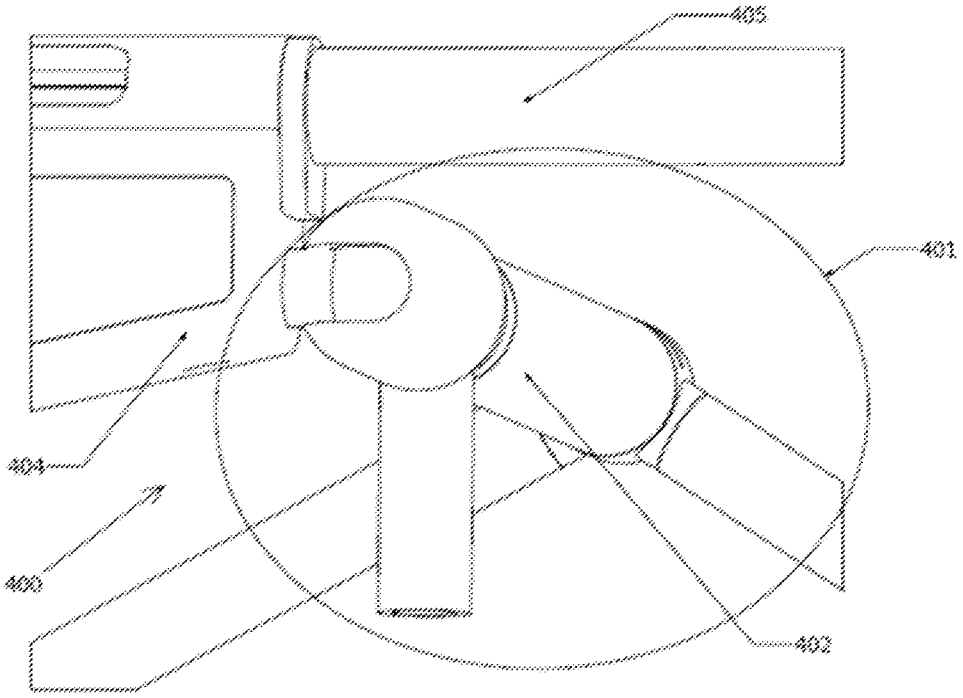

In some embodiments, and as shown in FIGS. 4A and 4B, an adjustable firearm support system 400 may comprise a support body 401 that may be positioned in various positions relative to the firearm or receiver. For example, as shown in FIG. 4B support body 401 can be positioned at about the 90 degree position relative to the receiver 404, with the forward grip 402 generally positioned perpendicular to the receiver 404 and barrel 405. Such a configuration provides support similar to that of a shooting stick to allow supported shooting from a kneeling or sitting position, or to utilize shorter support structures, such as a tree stump or short fence, without needing to lay or kneel down to avoid getting wet pants or knees. In colder weather, this may provide additional comfort and survivability while also offering the increased accuracy of a supported shooting platform. Of course, the support body 401 may be adjusted to any angle between 0 and 90 degrees relative to the receiver 404, suitable for adjustment to a variety of terrain or support opportunities.

In some embodiments, the adjustment handle may provide a close vertical grip as is preferred by some shooters over a horizontal forward grip. The adjustment handle may also be used to provide additional support and stability when the bipod is used to support the firearm. The support body may also be rotated such that the legs and the adjustment handle may be positioned at various angles as desired due to the adjustable nature of the adjustment assembly, such as with a ball and socket connection as shown in FIGS. 3A and 3B.

In competitive shooting, it is sometimes desirable to rest the firearm or a part of the competitor's body on a surface of an object for additional support while taking a shot. Some objects are shaped or disposed on a course in a manner that is awkward for the competitor to rest on the object or rest part of the firearm on the object in a way to get secure footing for the firearm and also hit the target accurately. For example, a competitor may desire to use a table on the course for additional support, but the table may not be large enough or sufficiently strong to accommodate the competitor's body and/or the firearm. Likewise, if the table is long and the competitor desires to put the support body of the firearm on an end of the table that is further from the target, the competitor would be at a disadvantage by being a farther distance from the target. Embodiments of the present invention allow for the support body to be positioned at an angle relative to the firearm, for example, about 80-90 degrees. As such the support body can be positioned on a side of the table closer to the target and provide the same amount of support for the firearm. In this configuration, the competitor and firearm would be disposed alongside the table instead of behind and/or on the table to gain this competitive advantage.

Figure 5:
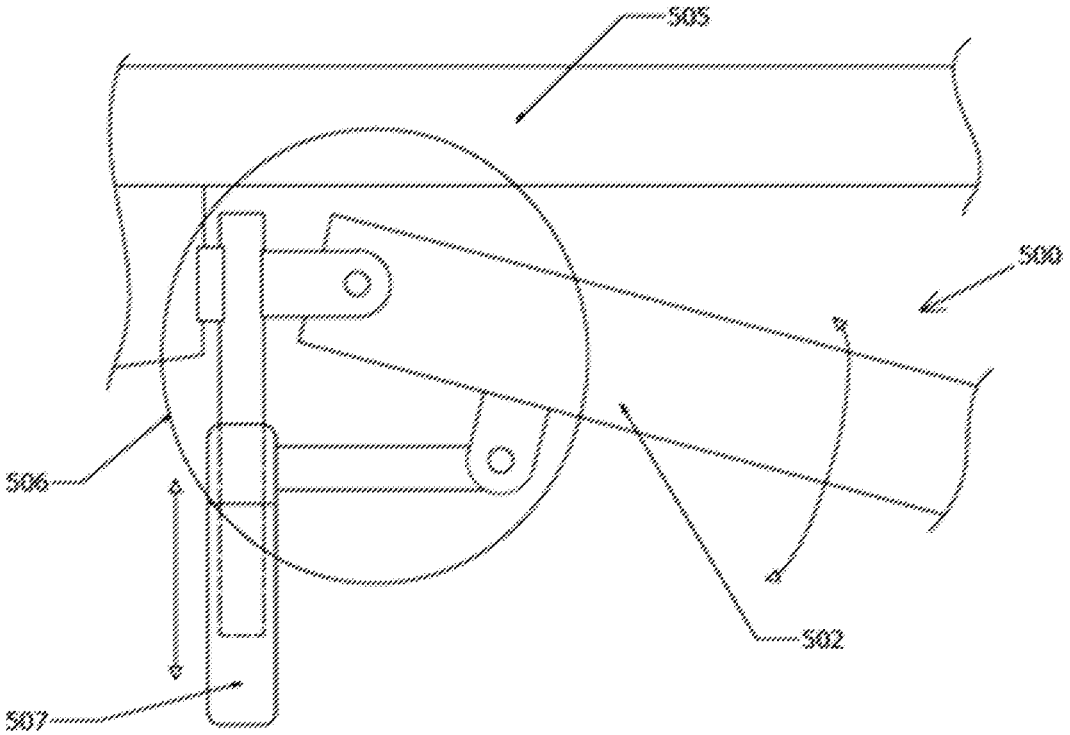
FIG. 5 is a schematic drawing of an exemplary adjustable firearm support.
Figure 6:
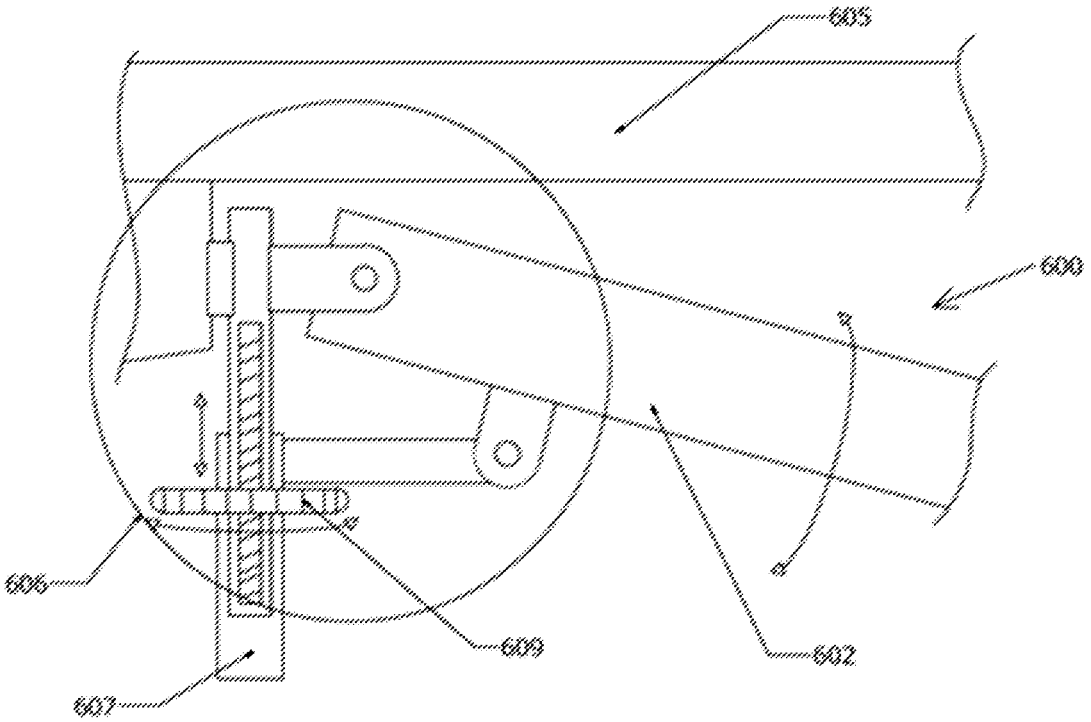
FIG. 6 is a schematic drawing of an exemplary adjustable firearm support.

As shown in FIGS. 5 and 6, other embodiments of an adjustable firearm support system 500, 600 may comprise an adjustment assembly 506, 606 may be used to adjust the support body and bipod. For example, FIG. 5 illustrates a sliding four-bar linkage that may be used to adjust or rotate the support body into a desired position. The adjustment handle 507, 607 may include a compression ring 609 such that when the handle is tightened the compression ring grips an inner tube within the adjustment handle 507, 607, thereby fixing the relationship between the various components and the position of the support body and forward grip 502, 602 as desired. In such embodiments, the support body may be pivotably attached to adjustment assembly and pivotably attached to a linkage bar connecting the support bar to the adjustment handle. The adjustment handle may then be configured to slidably engage with a portion fixed to the firearm, and the same fixed portion to which the support body is pivotably attached. Thus, when the adjustment handle moves up and down relative to the barrel 505, 605, the support body and forward grip 502, 602 pivot about the pivot connection with the fixed portion of the adjustment assembly and therefore also pivots with respect to the firearm.

As shown in FIG. 6, the adjustable firearm support system 600 may comprise an adjustment handle 607 that may also include a set screw or threadably engage with the fixed portion of the adjustment assembly to provide the desired angle adjustment of the support body in a manner similar to that of FIG. 1 and FIG. 5. In particular, the embodiment of FIG. 6 includes a rotating adjustment knob 609 to vertically move a fixed portion of the adjustment assembly 606 attached to the firearm to a sliding portion attached to the linkage bar to adjust the angle of the support body. Similarly, other mechanisms for selectively adjusting the position of the support body with respect to the firearm may be used to provide an adjustable forward grip and bipod as discussed and disclosed above.

In various embodiments, each component of the adjustable support may be formed of metals, such as steel, aluminum, titanium, plastics, carbon fiber, composite material, or other suitable material usable in firearms manufacturing, or any combination of suitable materials. Similarly, the various components may be machined, formed, cast, or otherwise produced using any suitable manufacturing technique.

Figure 7:
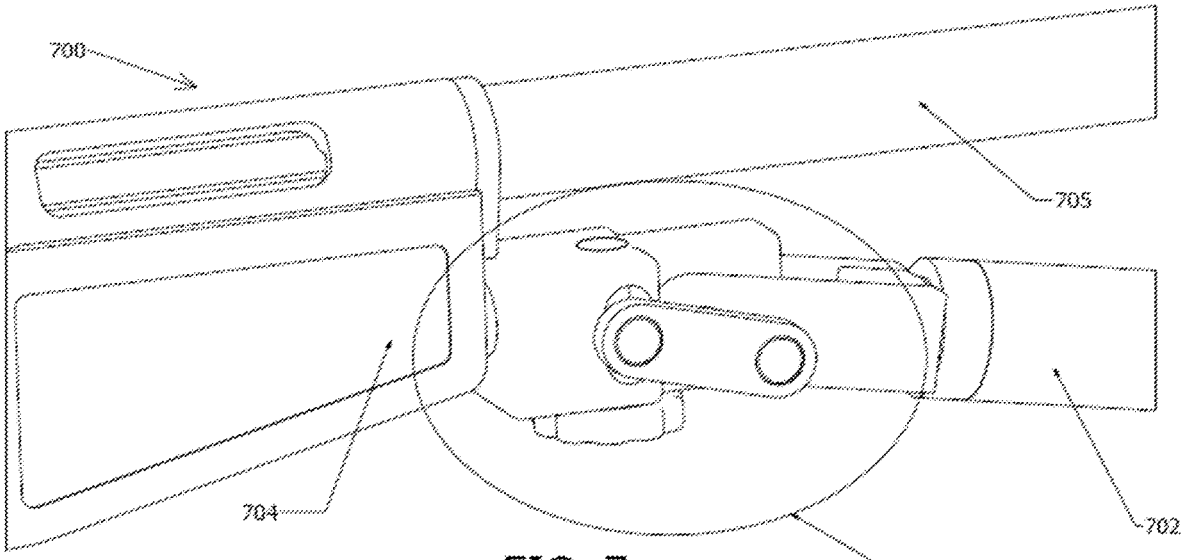
FIGS. 7 and 8 are schematic drawings illustrating another embodiment of an adjustable firearm support according to the invention.
Figure 8:
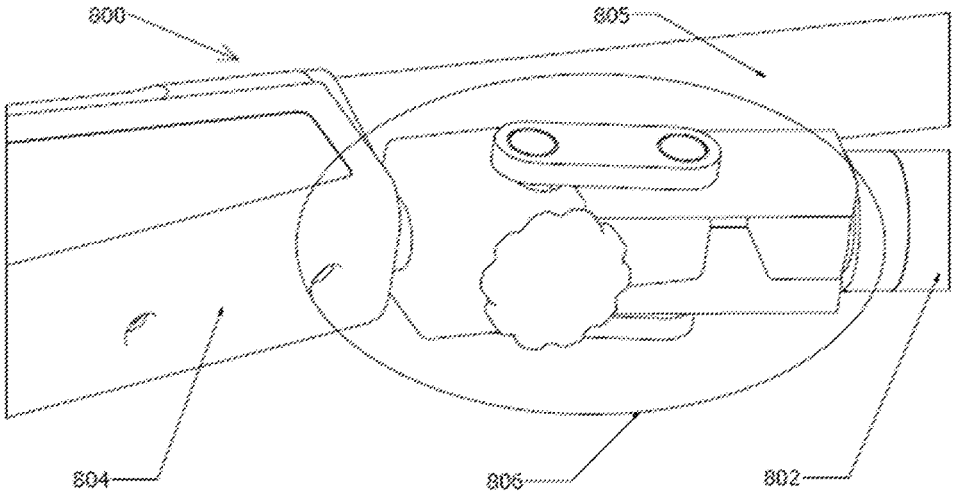

FIGS. 7 and 8 show another adjustable firearm support system 700, 800 according to an embodiment of the invention. The adjustment assembly 706, 806 can be manipulated to move forward grip 702, 802 up and down relative to the firearm barrel 705, 805 and/or the receiver 704, 804 to a desired position, for example, from 0 to 90 degrees relative to the receiver 704, 804.

Figure 9:
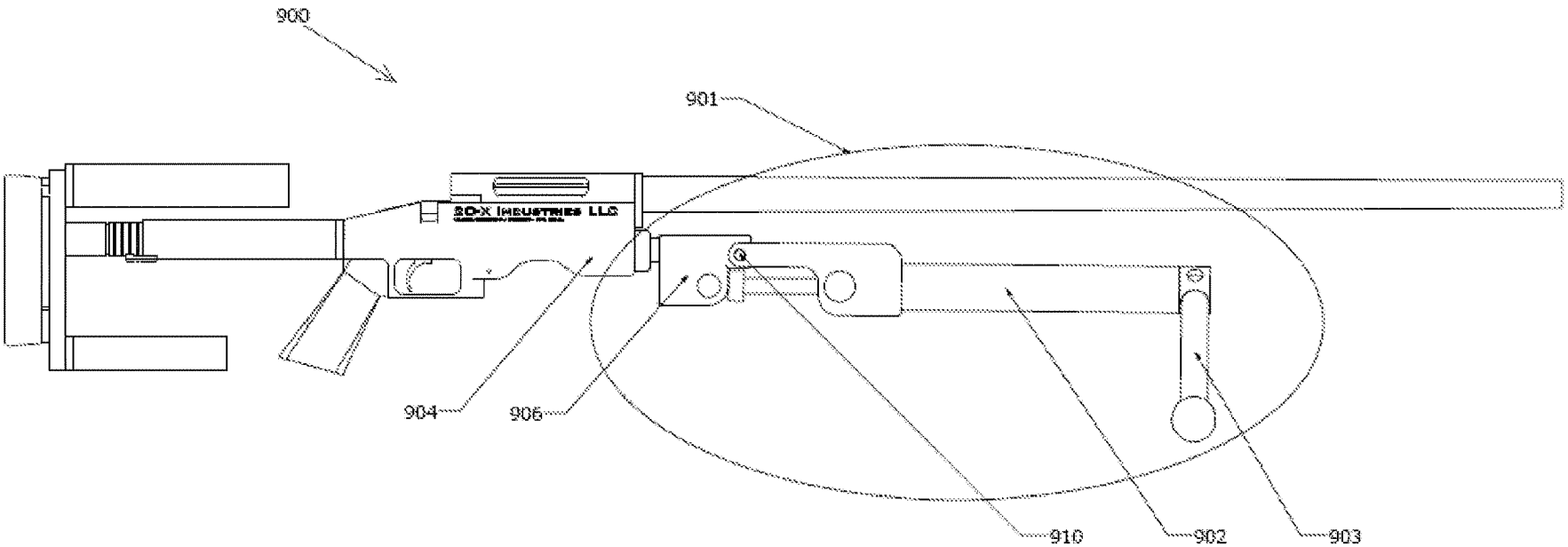
FIG. 9 is a schematic drawing of a firearm and adjustable firearm support.
Figure 10:
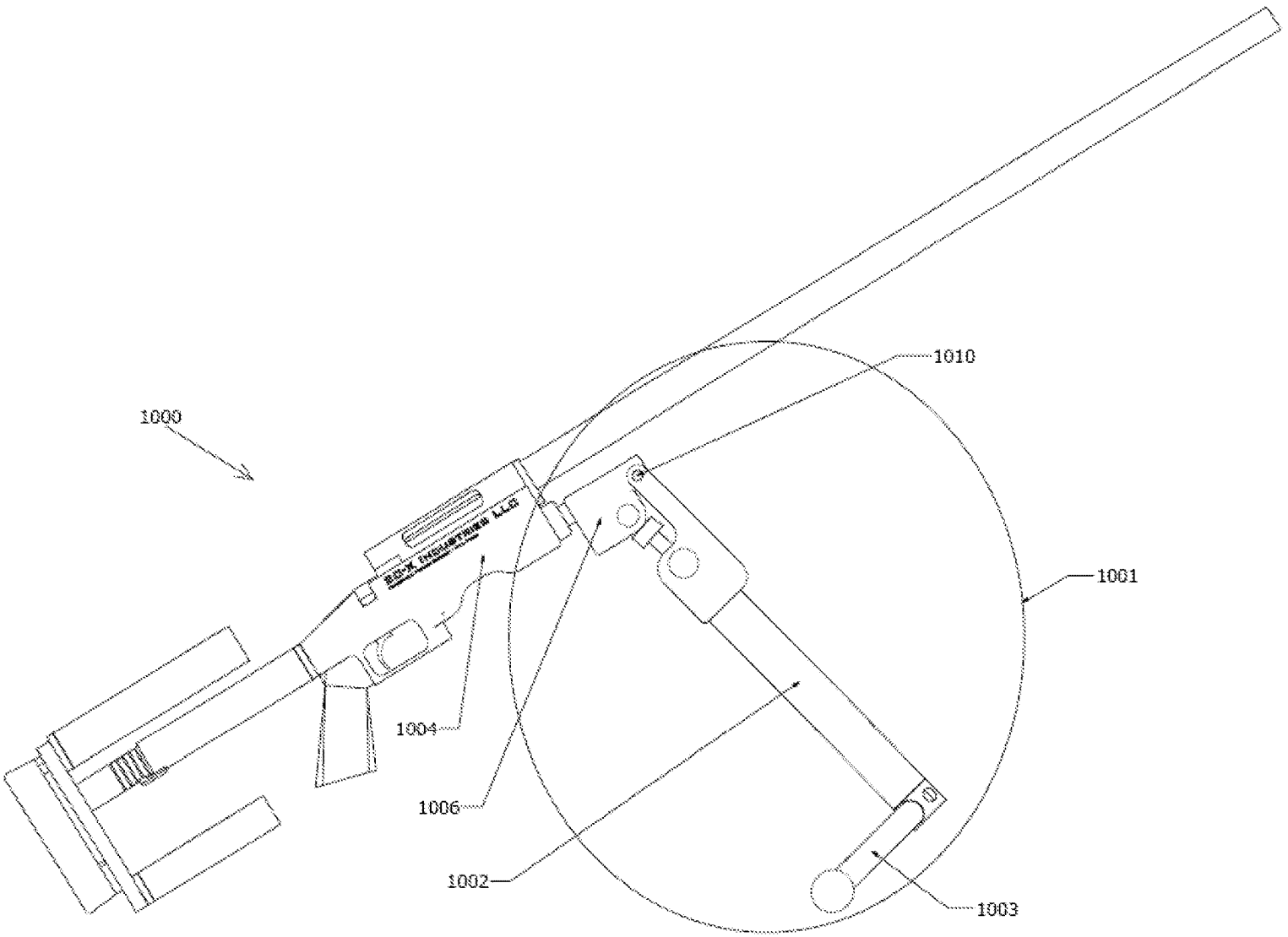
FIG. 10 is a schematic drawing of the exemplary firearm support illustrated in FIG. 9, which support is adjusted to a position between 0 and 90 relative to the firearm.

FIGS. 9 and 10 provide another embodiment of an adjustable firearm support system 900, 1000 according to the invention. As illustrated, provided is an adjustable firearm support 901, 1001 comprising: (a) a support body comprising a forward grip 902, 1002 and at least one support leg 903, 1003; (b) an adjustment assembly 906, 1006 connected at one end by a hinge 910, 1010 to the forward grip 902, 1002 of the support body and capable of being connected to a receiver 904, 1004 of a firearm at an opposing end; (c) wherein the hinge 910, 1010 is capable of providing for movement of the support body between about 0 and 90 degrees relative to the adjustment assembly 906, 1006; and (d) wherein the opposing end of the adjustment assembly 906, 1006 is configured for attachment to a receiver 904, 1004 of a firearm in a manner that provides for rotation of the adjustment assembly 906, 1006 between about 0 and 360 degrees relative to the receiver 904, 1004.

Figure 11:
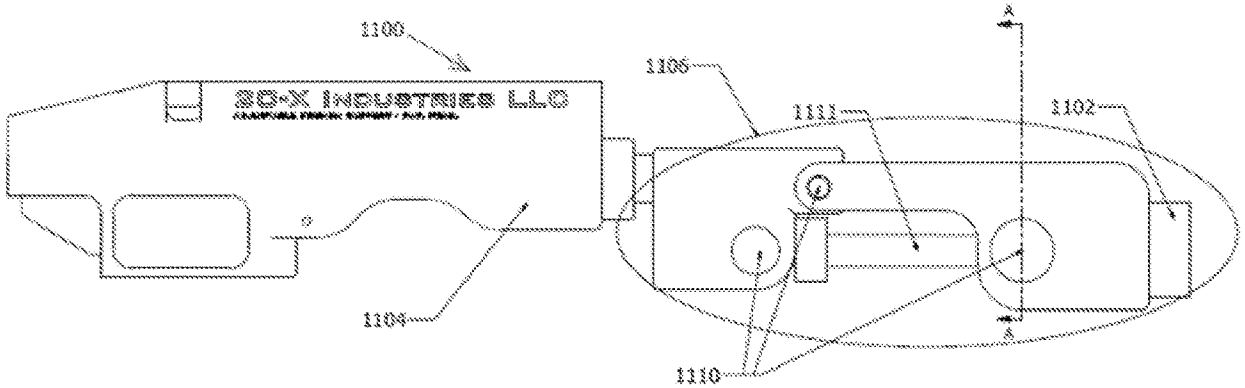
FIG. 11 is a schematic drawing of the firearm support illustrated in FIG. 9 and FIG. 10 showing connection of the support to the body of the firearm by way of the adjustment assembly.

FIG. 11 shows an adjustable firearm support system 1100 according to the invention. The support system 1100 comprises a forward grip 1102 that is in communication with an adjustment assembly 1106 that is in communication with a body of a firearm, for example, connected to the receiver 1104. In this embodiment, the adjustment assembly 1106 comprises a hinge system 1110 to provide for elevation adjustments of the firearm. More particularly, by rotating threaded rod 1111, the forward grip 1102 can be pulled toward the receiver 1104 to adjust the forward grip 1102 at an angle of between 0 to 90 degrees relative to the receiver 1104. For example, during use the angle between the forward grip 1102 and the receiver 1104 can be increased to increase elevation of the firearm.

Figure 12:
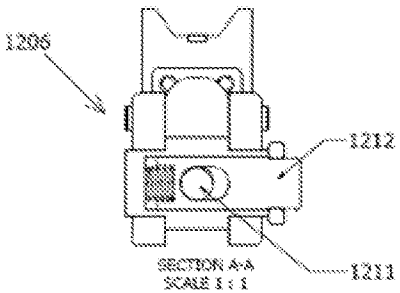
FIG. 12 is a schematic drawing providing a cross-sectional view along line A-A of the adjustment assembly shown in FIG. 11.

FIG. 12 shows a cross-sectional view of the adjustment assembly 1206 shown in FIG. 11. As shown, a spring-loaded half nut mechanism 1212 can be used to provide a mechanism for locking the adjustment assembly 1206 in a desired position. When the half nut mechanism 1212 is in an inactive state (locked in a desired position), threaded rod 1211 is in communication with internal threading of the half nut mechanism 1212. The adjustment assembly 1206 can be adjusted by rotating the threaded rod 1211 either further into or out of the half nut 1212. This allows for fine tune adjustments of firearm elevation. Half nut 1212 is threaded only on a portion of its interior, for example, half of the interior. This way, by pressing the half nut mechanism 1212 toward the spring and compressing the spring, the threaded rod 1211 is released from the internal threading and can then slide freely through the half nut 1212. This allows for large changes in elevation of the firearm. Once the threaded rod 1211 is at a desired position (and the firearm is at a desired elevation), the half nut 1212 is released and the spring then causes the threaded rod 1211 to come back into contact with the threaded portion of the half nut interior, thereby locking the adjustment assembly 1206 in place and allowing for fine tune adjustments of the firearm elevation if needed.

Figure 13:
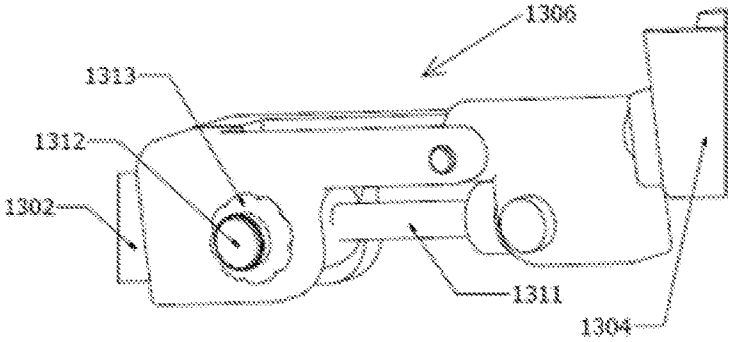
FIG. 13 is a schematic drawing providing a detailed view of an adjustment assembly according to an embodiment of the invention.

FIG. 13 shows the opposing side of the adjustment assembly 1306 illustrated in FIG. 11. As shown, a locking ring 1313 is provided for communication with and locking of the half nut 1312. To prevent inadvertent activation of half nut 1312, the locking ring 1313 can be provided to release the half nut 1312 for use. By tightening the locking ring 1313 (rotating the locking ring 1313 clockwise), the half nut 1312 is locked in position and by rotating the locking ring 1313 counterclockwise, the half nut 1312 can be released so that a user of the adjustment assembly 1306 is capable of pressing the half nut 1312 into the adjustment assembly 1306 to release the threaded rod 1311. When threaded rod 1311 is pushed into half nut 1312, forward grip 1302 can be positioned at a higher angle relative to the receiver 1304 (moving from 0 to 90 degrees) to increase elevation of the firearm to which the adjustment assembly 1306 is attached. Then the threaded rod 1311 can be retracted from half nut 1312 to position forward grip 1302 closer to the barrel of the firearm (moving the forward grip from 90 degrees to 0 degrees).

Figure 14:
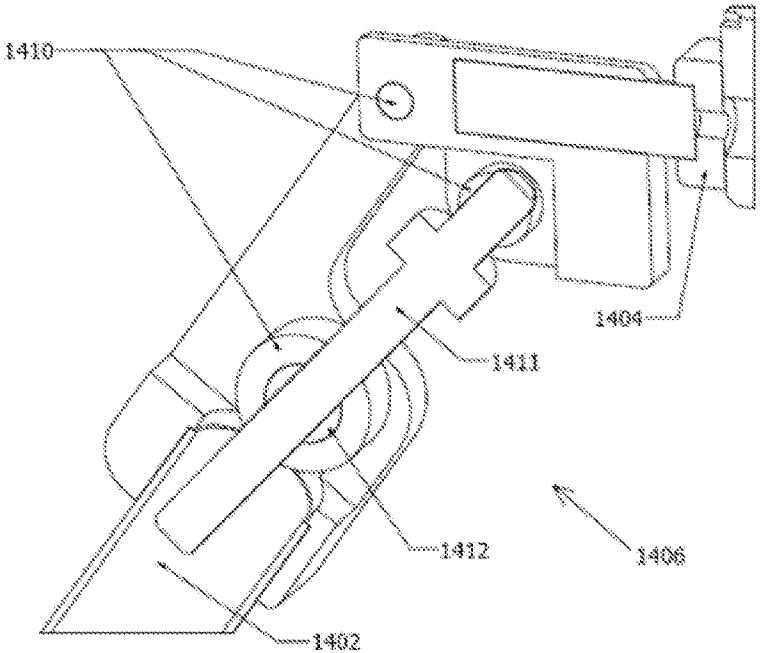
FIG. 14 is a schematic drawing of a cross-sectional view of the adjustment assembly shown in FIG. 13.

FIG. 14 shows a cross-sectional view of the adjustment assembly 1406 illustrated in FIG. 13. Here, the adjustment assembly 1406 is adjusted so that the firearm is positioned at a desired higher elevation. As shown, as threaded rod 1411 is rotated into half nut 1412, the interaction between the threaded rod 1411 and the half nut 1412 causes forward grip 1402 to move away from the barrel of the firearm toward the receiver 1404 into a desired position. Here, forward grip 1402 is positioned between 45 and 90 degrees relative to receiver 1404. As threaded rod 1411 is rotated or pushed into half nut 1412, hinges 1410 are activated to provide for movement of the forward grip 1402 relative to the receiver 1404.

In addition to any previously indicated modification, numerous other variations and alternative arrangements may be devised by those skilled in the art without departing from the spirit and scope of this description, and appended claims are intended to cover such modifications and arrangements. Thus, while the disclosed embodiments have been described above with particularity and detail in connection with what is presently deemed to be the most practical and preferred aspects, it will be apparent to those of ordinary skill in the art that numerous modifications, including, but not limited to, form, function, manner of operation, and use may be made without departing from the principles and concepts disclosed and described above. Also, the examples and embodiments, in all respects, are meant to be illustrative only and should not be construed to be limiting in any manner of the claims.

The invention claimed is:

1. A support for a long gun having a frame with a barrel mounting facility, and a barrel having a breech end connected to the barrel mounting facility and an opposed muzzle, the support comprising:

a base having a rear portion operable for connection to the frame proximate the barrel mounting facility;

the base having a forward portion forward of the rear portion and pivotally connected to the rear portion to pivot about a pivot location proximate the barrel mounting facility;

an arm defining an arm axis and movably connected to the forward portion of the base and extending away from the frame;

an adjustment facility operable to establish a selected angular relationship between the arm and the frame;

wherein the arm has a free end and a foot connected to the free end;

wherein the foot has two spaced apart contact surfaces such that a bipod capability is provided;

wherein the foot includes a pair of elongated legs, each angularly offset from each other and from the arm;

wherein the legs are two elongated elements joined at a vertex and spread apart from each other to define a plane angularly offset from the arm axis;

wherein the arm has a rear end connected to the base proximate the breech end of the barrel and the free end is connected to the legs at the vertex;

wherein the arm is operable to pivot through a range of positions between a first position substantially parallel to the barrel and a second position angularly disposed away from the barrel in a medial plane defined by the frame and the barrel;

wherein the bipod capability can be provided for every position of the arm in the range of positions between and including the first position and the second position without pivoting the legs with respect to the arm; and wherein a locking mechanism is adapted to secure the arm against motion in any of the range of positions such that an elevation of the muzzle may be adjusted by pivoting the arm.

2. The support of claim 1 wherein the arm is more than half the length of the barrel.

3. The support of claim 1 wherein the adjustment facility has a range of travel and the locking mechanism has an unlocked condition in which the arm is operable to pivot with respect to the frame and a locked position in which the arm is fixed at a selected position with respect to the frame, the arm being infinitely adjustable within the range of travel of the adjustment facility.

4. The support of claim 3 wherein the adjustment facility includes a threaded adjustor having a threaded shaft threadedly engaged to a threaded sleeve, and wherein one of the shaft and the sleeve is connected to one of the arm and the base, and the other of the shaft and the sleeve is connected to the other of the arm and the base, such that adjustment changes the selected angular relationship between the arm and the frame.

5. The support of claim 3 wherein the locking mechanism is operable to secure the arm at any position within a range of angular positions with respect to the barrel.

6. The support of claim 1 wherein the arm is operable to move from the first position in which the arm is substantially parallel to and adjacent to the barrel, and the second position in which the arm is angularly disposed away from the barrel by a selected angle.

7. The support of claim 6 wherein the selected angle is up to 90 degrees from the barrel.

8. The support of claim 1 wherein a plane of the legs is perpendicular to the arm axis.

9. The support of claim 1 wherein the frame has a forward face and the base extends forward of the forward face.

10. A long gun having an adjustable support, comprising:

a frame having a barrel mounting facility;

a barrel having a breech end connected to the barrel mounting facility;

the support having a base connected to the frame proximate the barrel mounting facility;

the base having a rear portion received by the frame below the breech end and a forward portion;

the forward portion being pivotally connected to the rear portion to pivot about a pivot location proximate the barrel mounting facility;

the support having an arm defining an arm axis and movably connected to the forward portion of the base and extending away from the frame;

the support having an adjustment facility operable to establish a selected angular relationship between the arm and the frame and to secure the arm in any of a selected plurality of angles between a first angle proximate the barrel and a second angle away from the barrel;

wherein the arm has a free end, and including a foot connected to the free end;

wherein the foot has two spaced apart contact surfaces such that a bipod capability is provided;

wherein the foot includes a pair of elongated legs, each angularly offset from each other and from the arm;

wherein the legs are two elongated elements joined at a vertex and spread apart from each other to define a plane angularly offset from the arm axis;

wherein the arm has a rear end connected to the base proximate the breech end of the barrel and the free end is connected to the legs at the vertex; and wherein the bipod capability can be provided for every angle of the arm in the selected plurality of angles between and including the first angle and the second angle without pivoting the legs with respect to the arm.

11. The long gun of claim 10 wherein the arm is more than half the length of the barrel.

12. The long gun of claim 10 wherein the adjustment facility has a range of travel and includes a locking element having an unlocked condition in which the arm is operable to pivot with respect to the frame and a locked position in which the arm is fixed at a selected position with respect to the frame, the arm being infinitely adjustable within the range of travel of the adjustment facility.

13. The long gun of claim 12 wherein the adjustment facility includes a ball and socket.

14. The long gun of claim 12 wherein the selected position of the arm with respect to the frame is greater than or equal to 0 degrees and less than or equal to 90 degrees.

15. The long gun of claim 12 wherein the locking element is operable to secure the arm at any position within a range of angular positions with respect to the barrel.

16. The long gun of claim 10 wherein the selected angular relationship between the arm and the frame is up to 90 degrees.

17. The long gun of claim 10 wherein the plane of the legs is perpendicular to the arm axis.

18. The long gun of claim 10 wherein the frame has a forward face and the base extends forward of the forward face.

* * * * *